US009924740B2

(12) United States Patent
Griesmayr et al.

(10) Patent No.: US 9,924,740 B2
(45) Date of Patent: Mar. 27, 2018

(54) LAYER COMPOSITE FOR A FILTER OF AN ARTICLE TO SMOKE

(71) Applicant: TANNPAPIER GMBH, Traun (AT)

(72) Inventors: Guenter Griesmayr, Wels (AT); Barbara Puehringer, Oftering (AT); Bernhard Knauseder, Leonding (AT)

(73) Assignee: TANNPAPIER GMBH, Traun (AT)

( * ) Notice: Subject to any disclaimer, the term of this patent is extended or adjusted under 35 U.S.C. 154(b) by 260 days.

(21) Appl. No.: 14/428,733

(22) PCT Filed: Sep. 16, 2013

(86) PCT No.: PCT/AT2013/050184
§ 371 (c)(1),
(2) Date: Mar. 17, 2015

(87) PCT Pub. No.: WO2014/040109
PCT Pub. Date: Mar. 20, 2014

(65) Prior Publication Data

US 2015/0237912 A1 Aug. 27, 2015

(30) Foreign Application Priority Data

Sep. 17, 2012 (AT) ..... A 1013/2012

(51) Int. Cl.
*A24D 3/04* (2006.01)
*A24D 1/02* (2006.01)
*A24B 15/28* (2006.01)

(52) U.S. Cl.
CPC ..... *A24D 1/02* (2013.01); *A24B 15/282* (2013.01); *A24D 3/04* (2013.01)

(58) Field of Classification Search
None
See application file for complete search history.

(56) References Cited

U.S. PATENT DOCUMENTS 2,755,206 A 7/1956 Statia
3,460,959 A 8/1969 Neuhaus
(Continued)

FOREIGN PATENT DOCUMENTS

AT 260756 3/1968
CN 2193654 4/1995
(Continued)

OTHER PUBLICATIONS

International Search Report for PCT/AT2013/050184, English Translation attached to original, Both completed by the European Patent Office dated Feb. 20, 2014, All together 5 Pages.
(Continued)

*Primary Examiner* — Michael H Wilson
*Assistant Examiner* — Phu Nguyen
(74) *Attorney, Agent, or Firm* — Brooks Kushman P.C.

(57) ABSTRACT

A layer composite acting as a covering for the filter of an article to smoke, which includes a filter cover which allows diffusion and a mouthpiece lining paper arranged outside said filter cover, the mouthpiece lining paper being in contact with a sensory substance area. A layer which is impervious to the substances contained in the sensory substance area is arranged between the mouthpiece lining paper and the filter cover. The filter cover consists of a material which allows diffusion.

14 Claims, 6 Drawing Sheets

(56) References Cited

U.S. PATENT DOCUMENTS

| | | | |
|---|---|---|---|
| 3,916,914 | A | 11/1975 | Brooks et al. |
| 4,121,595 | A | 10/1978 | Heitmann et al. |
| 4,185,643 | A | 1/1980 | Riedesser |
| 4,286,605 | A | 9/1981 | Goslin et al. |
| 4,295,478 | A | 10/1981 | Yeatts |
| 4,361,156 | A | 11/1982 | Hall |
| 4,411,279 | A | 10/1983 | Martin et al. |
| 4,434,805 | A | 3/1984 | Hall |
| 4,583,558 | A | 4/1986 | Luke |
| 4,614,199 | A | 9/1986 | Berger |
| 4,643,205 | A | 2/1987 | Redding et al. |
| 4,675,064 | A | 6/1987 | Berger |
| 4,869,275 | A | 9/1989 | Berger |
| 6,832,613 | B2 | 12/2004 | Brunbauer |
| 6,929,013 | B2 | 8/2005 | Ashcraft et al. |
| 8,720,451 | B2 | 5/2014 | Bartram |
| 2003/0178039 | A1 | 9/2003 | White et al. |
| 2005/0196604 | A1* | 9/2005 | Funicelli ..... B44C 1/1737 428/323 |
| 2008/0029111 | A1 | 2/2008 | Dube et al. |
| 2008/0156336 | A1 | 7/2008 | Wyss-Peters et al. |
| 2010/0108084 | A1 | 5/2010 | Norman et al. |
| 2011/0155000 | A1 | 6/2011 | Kaljura et al. |
| 2012/0240948 | A1 | 9/2012 | Griesmayr |
| 2013/0093117 | A1 | 4/2013 | Griesmayr |
| 2013/0139837 | A1 | 6/2013 | Kaljura et al. |
| 2013/0199550 | A1 | 8/2013 | Ono |

FOREIGN PATENT DOCUMENTS

| | | |
|---|---|---|
| CN | 201141102 | 10/2008 |
| CN | 201365521 | 12/2009 |
| CN | 201365522 | 12/2009 |
| CN | 202157246 | 3/2012 |
| CN | 202416072 | 9/2012 |
| DE | 630817 | 6/1936 |
| DE | 1928432 | 12/1965 |
| DE | 1532252 | 2/1970 |
| DE | 1757235 | 4/1971 |
| DE | 2327822 | 12/1974 |
| DE | 2743986 | 4/1979 |
| DE | 2927893 | 10/1984 |
| DE | 3005793 | 5/1985 |
| DE | 3411511 | 6/1995 |
| DE | 102005025758 | 12/2006 |
| EP | 0539009 | 4/1993 |
| EP | 0838166 | 4/1998 |
| EP | 1044615 | 10/2000 |
| EP | 1891866 | 2/2008 |
| EP | 1942753 | 5/2009 |
| EP | 1895863 | 12/2009 |
| GB | 269194 | 12/1927 |
| GB | 294492 | 7/1928 |
| GB | 334271 | 9/1930 |
| GB | 337501 | 11/1930 |
| GB | 433228 | 8/1935 |
| GB | 1422286 | 1/1976 |
| GB | 2135912 | 9/1984 |
| GB | 2199726 | 7/1988 |
| JP | 2007527338 | 9/2007 |
| JP | 2009148233 | 7/2009 |
| JP | 2013505729 | 2/2013 |
| JP | 2013529090 | 7/2013 |
| WO | 0158289 | 8/2001 |
| WO | 2004052128 | 6/2004 |
| WO | 2006128551 | 12/2006 |
| WO | 2007052170 | 5/2007 |
| WO | 2008019281 | 2/2008 |
| WO | 2009027331 | 3/2009 |
| WO | 2010051076 | 5/2010 |
| WO | 2011001200 | 1/2011 |
| WO | 2011038430 | 4/2011 |
| WO | 2011042353 | 4/2011 |
| WO | 2011060459 | 5/2011 |
| WO | 2011154246 | 12/2011 |
| WO | 2012049880 | 4/2012 |
| WO | 2013046327 | 4/2013 |

OTHER PUBLICATIONS

Definition of "lacquer", The Free Dictionary by Farlex, [online], No Date, retrieved fron the Internet on May 8, 2015, URL: http//www.thefreedictionary.com/lacquer.

Japanese Office Action for Japanese Application No. JP2015-531401, English translation attached to original, Both completed by the Japanese Patent Office, dated Apr. 25, 2017, 6 Pages all together.

Japanese Search Report for Japanese Application No. JP 2015-531401, English translation attached to original, Both completed by the Japanese Patent Office, dated Apr. 18, 2017, 28 Pages Alltogether.

* cited by examiner

LAYER COMPOSITE FOR A FILTER OF AN ARTICLE TO SMOKE

CROSS-REFERENCE TO RELATED APPLICATION

This application is the U.S. national phase of PCT Application No. PCT/AT2013/050184 filed on Sep. 16, 2013, which claims priority to AT Patent Application No. A 1013/2012 filed on Sep. 17, 2012, the disclosures of which are incorporated in their entirety by reference herein.

The invention relates to a layer composite which covers the filter fitted to a smoking article.

The term "smoking article" means a cigarette or a cigarillo. The invention will be described further by using the application to cigarettes, although it can also be applied to cigarillos if the latter are provided with a filter.

The important parts of filter cigarettes that are common nowadays are an approximately circularly cylindrical tobacco rod, a filter which adjoins the latter at one end and is likewise approximately circularly cylindrical, cigarette paper, which covers the tobacco rod, filter cover (often also designated as "filter cover paper"), which wraps around the filter directly, and mouthpiece lining paper (often also called "mouthpiece lining", "tipping" or "tipping paper"), which wraps both around the filter cover and also the part of the cigarette paper that is close to the filter and thus connects tobacco rod and filter to each other via the coverings thereof. The mouthpiece lining paper is that part of the cigarette which is touched directly during smoking by the lips of the person smoking the cigarette. Even if the term "mouthpiece lining paper" contains the word "paper", the mouthpiece lining paper does not necessarily have to be a real paper. It can, for example, also be formed by a film, for example made of cellulose hydrate, or else by a composite of various layers, which do not necessarily need to consist of paper.

It is usual to influence the sensations of an individual who smokes a cigarette by adding sensory substances to cigarettes. In this sense, "sensory substances" are substances which cause sensations in the smoking individual, such as coldness (freshness) or heat or a sensation of taste. The addition of sensory substances to the tobacco rod is widespread. It has also already been proposed to add sensory substances to the filter or to the mouthpiece lining paper.

In the documents EP 1891866 A1, EP 1942753 B1, EP 539009 A2, U.S. Pat. No. 4,643,205 A, WO2007052170 A2, WO2008019281 A2 and WO2010051076 A1 it is proposed to provide the mouthpiece lining paper with a sensory substance, for example to impregnate the same with a liquid sensory substance. As a result of contact of the mouthpiece lining paper with the lips, a pleasant sensation, for example a sensation of taste or a sensation of freshness, can therefore be experienced even if one is not drawing on the cigarette. According to the two last-named WO documents, it is proposed to arrange the mouthpiece lining paper provided with a sensory substance as the third, outermost covering layer around the cigarette filter and to fix this layer such that it can optionally be removed by the smoking individual.

In U.S. Pat. No. 4,675,064 A it is proposed to form the filter core and a circularly cylindrical layer covering the latter directly from cellulose acetate, wherein the material in the filter core is present as fibers and in the covering layer is present as an impervious extruded shell. U.S. Pat. No. 4,869,275 A proposes the same structure, using a plastic instead of cellulose acetate. Because the same material is used for core and the envelope of the filter adjoining the same directly, the production method is economical, since offcuts can easily be fed back into the production process. Since the envelope forms a rigid shell, the core itself can be soft and therefore formed from extremely thin fibers, so that it has a high internal surface. Since the envelope is impervious, it prevents the unintended ingress of substances from the mouthpiece lining paper. The use of sensory substances for the mouthpiece lining paper is not mentioned. The impervious covering of the filter core has proven to be disadvantageous, however. Substances such as triacetin, with which the fibers of the filter core have to be treated during the production and processing thereof, consequently cannot evaporate through the enveloping surface of the filter but at best only via the end faces. In a manner intensified by the intended particularly large internal surface of the filter core, the evaporation via the end faces during the usual and intrinsically economical production sequences can take place only with an extreme expenditure of time, since the filter blanks comprising filter core and immediate covering are produced with many times the length of an ultimate cigarette filter and undergo their last dividing step only in the cigarette making machine.

Primarily to set smoking values, the coverings around the filter are designed to be porous, that is to say air-permeable, so that when drawing on the cigarette it is not only smoke that passes through the tobacco rod into the filter and into the mouth of the smoking individual, but also fresh air via the enveloping surface area of the mouthpiece lining paper which is exposed. Therefore, sensory substances which are contained in the mouthpiece lining paper or substances which serve as carriers for sensory substances are inhaled together with the smoke coming from the tobacco rod. For this reason, it is possible to use on the mouthpiece lining paper only those sensory substances and carrier substances for the latter which are not damaging or annoying when inhaled or do not interact in an annoying manner with the stream of smoke. Furthermore, the fact that sensory substances or the carrier substances of the latter diffuse from the mouthpiece lining paper into the filter covering and into the material of the filter to a high extent is unfavorable.

It has been shown that sensory substance which has been applied to a mouthpiece lining paper is barely still effective following the processing in the cigarette making machine of the mouthpiece lining paper provided with the sensory substance, for example barely still causes a sensation of taste when the mouthpiece lining paper on the finished cigarette is touched with the lips.

WO 2011/038430 A1 describes a layer structure of a filter cigarette in which the mouthpiece lining paper is equipped with viewing openings, which permit a view of the layer lying underneath. In addition to the mouthpiece lining paper, further layers such as the filter cover paper and one or more intermediate layers can also be present and equipped with viewing windows. The intermediate layer can fulfill a specific function, which lies in influencing the smoking values or the aroma of the cigarette. Thus, the intermediate layer can be provided with aromatic substances which, during smoking, get into the filter and thus into the cigarette smoke. In one embodiment, the viewing openings of the mouthpiece lining paper are covered with a transparent layer to prevent, during the gluing of the mouthpiece lining paper to the layer lying underneath, the used glue from passing through the viewing openings. The simultaneous presence of an intermediate layer with aromatic substances and a covering layer covering the viewing windows is not described. In the case of a layer structure that would contain both of said layers, the mouthpiece lining paper would be separated from the intermediate layer by the covering layer. The mouthpiece lining paper would accordingly not be in contact with the sensory substance area of the intermediate layer and is not provided with such sensory substance area. There is no dividing layer between the intermediate layer containing the aromatic substances and the filter or the filter covering paper.

In the documents CN 201365521 Y and CN 201365522 Y it is proposed to form the filter from an inner circularly cylindrical part and an outer tubular part and, in the inner circularly cylindrical part, to arrange strands of material wetted with sensory substance extending in the longitudinal direction of the cigarette. According to the first of the two aforementioned documents, it is proposed to provide the filter within the aforementioned coverings with a further covering layer which has air channels which extend in the axial direction of the cigarette, approximately from the longitudinal center of the filter as far as the end on the smoker side. The formation of said channels is used to compose the volume stream drawn out of the cigarette by the smoking individual as advantageously as possible from a partial stream coming through the tobacco rod and a partial stream coming through the air-permeable covering layers of the filter. All the covering layers of the filter are permeable to air and to the diffusion of sensory substances.

The documents U.S. Pat. No. 2,755,206 A, U.S. Pat. No. 3,916,914 A, CN 2193654 Y and EP 1895863 B1 describe cigarette filters which have sensory substances in liquid form stored in the filter core, wherein these substances are typically preserved in a capsule which, by means of an external compressive force, can be broken open to such an extent that the substance can come into contact with the stream of smoke from the tobacco part of the cigarette and can develop its effect. In order that the liquid substance, often an oily substance, does not impregnate and discolor the mouthpiece lining paper, that is to say the outermost covering layer of the filter of the finished cigarette, the mouthpiece lining paper and the filter core containing the liquid substance are separated by an intermediate layer in the form of a circularly cylindrical envelope made of a liquid-impervious separating material. Neither the mouthpiece lining paper nor the part of the impervious layer coming into contact with the latter has a sensory substance, such as a substance causing a sensation of freshness.

It has been shown that it is not just possible for sensory substances which are contained in the filter core to discolor the mouthpiece lining paper but also for sensory substances which are added to the tobacco. This is typically the case in what are known as kretek cigarettes, which are primarily widespread in Indonesia. In this case, clove is added to the cigarette tobacco. An oil diffuses out of the clove and later discolors the cigarette paper in an unsightly manner. EP 1 044 615 B1 deals with the problem that—primarily under unfavorable ambient conditions—substances can diffuse out of the tobacco into the adjacent cigarette paper and cause visible spots on the latter. In order to avoid this, it is proposed to use cigarette paper which is provided with a water-repellent impregnation of the cellulose derivative, in particular ethyl cellulose, wherein cigarette paper and impregnation are coordinated in such a way that the air permeability of the impregnated paper is at least 20 Coresta units.

By forming cigarette paper in accordance with EP 1 044 615 B1, it is possible to prevent cigarette paper from being discolored by oil which diffuses out of the clove that is added to the tobacco in kretek cigarettes. However, it has been shown that this oil (and also other oils which are contained in the tobacco rod) also discolor the mouthpiece lining paper in an unsightly manner above all during the smoking of a cigarette.

The object on which the invention is based consisted in providing a layer composite containing the mouthpiece lining paper for the covering of the filter part of a cigarette, by means of which the mouthpiece lining paper, that is to say the outermost layer of the filter covering which is to be touched by lips and/or fingers, is not discolored by oily substances which are contained in the tobacco rod.

In order to achieve this object, it is proposed to use as covering for the filter part of the cigarette a layer composite which comprises mouthpiece lining paper and filter cover paper and a layer that is impervious to sensory substances, wherein the impervious layer is arranged between the mouthpiece lining paper and the filter cover paper.

By means of the impervious layer, the oily components of the sensory substances are prevented from reaching the mouthpiece lining paper at all. Nevertheless, it is possible to use a filter cover paper which is open to diffusion, with which the disadvantages, mentioned above with reference to U.S. Pat. No. 4,675,064 A and U.S. Pat. No. 4,869,275 A, of impervious layers as filter cover paper for the production process of filters can be circumvented.

In the course of further deliberations in this regard, it was surprisingly understood that, by means of this layer composite, advantages result for the use of sensory substances that are applied to the mouthpiece lining paper which are very much more valuable than the simple achievement of the originally intended purpose of avoiding the discoloration of the mouthpiece lining paper by oily substances from the tobacco rod.

Specifically, many restrictions with respect to sensory substances which are applied on or to the mouthpiece lining paper are overcome. It is therefore possible for a broader selection of sensory substances to be used, larger quantities of sensory substances can be used, more combinations of different sensory substances can be applied, and sensory substances can also be used in those aggregate states in which they were hitherto not usable.

The invention will be illustrated with the aid of a number of stylized basic drawings, in which, for reasons of clarity, above all the individual covering layers are illustrated disproportionately thickly:

The filter cigarettes illustrated by way of example and built up circularly symmetrically comprise a tobacco rod 1 and a filter 2. The tobacco rod 1 is covered by cigarette paper 3. The filter 2 is covered by a filter cover 4.

Figure 1:
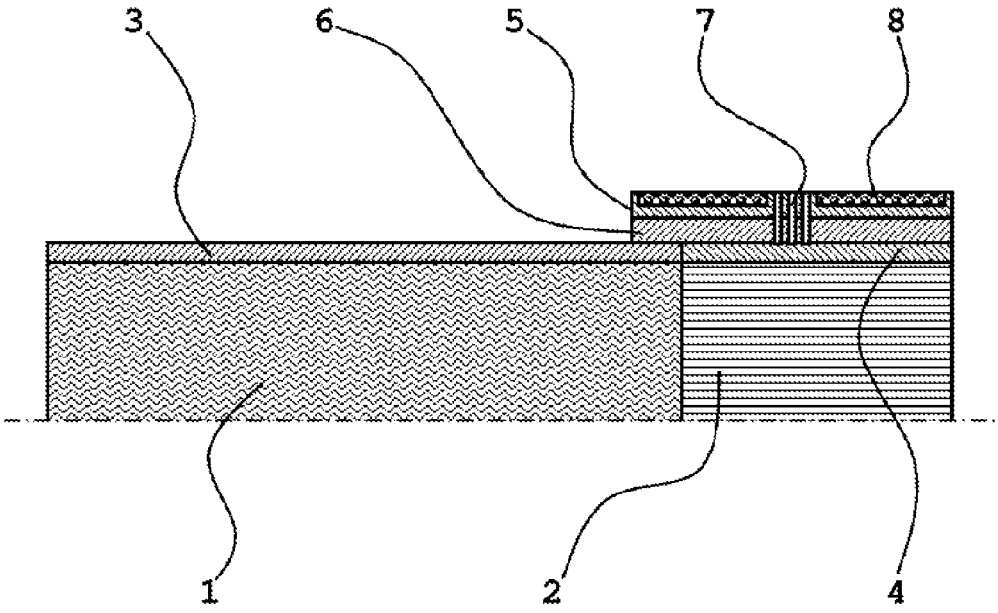
FIG. 1 shows a lateral sectional view, stylized and not to scale, of a first filter cigarette equipped with an exemplary layer composite according to the invention.
Figure 2:
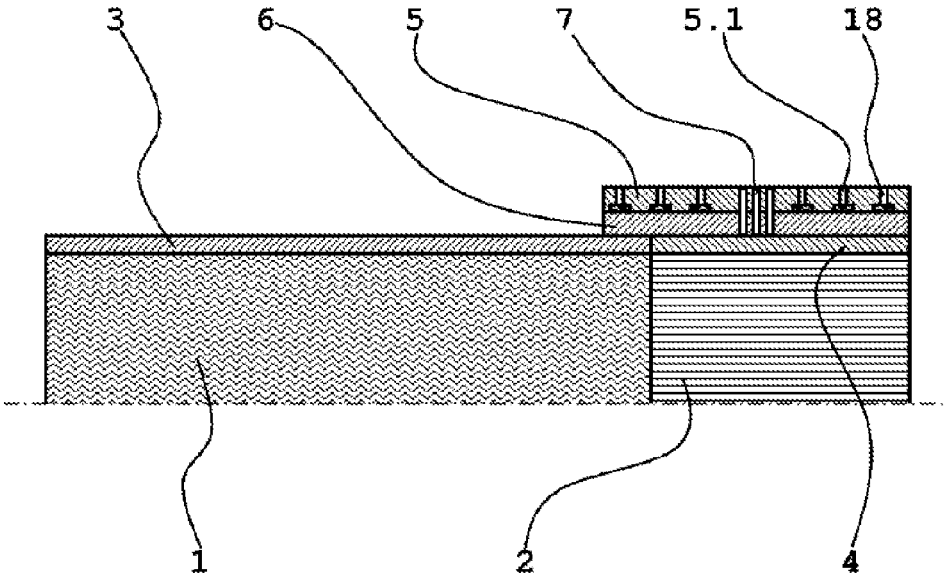
FIG. 2 shows a second filter cigarette equipped according to the invention by way of example in the same view as FIG. 1.

A layer composite which comprises an impervious layer 6 and the mouthpiece lining paper 5 arranged over the latter on the outside covers the filter cover 4 and, in the examples according to FIG. 1 and FIG. 2, also covers the part of the cigarette paper 3 close to the filter. The impervious layer 6 of the layer composite is at least lightly adhesively connected to the covered layers comprising filter cover and cigarette paper.

The outer layer of said layer composite, the mouthpiece lining paper 5, is in contact with a sensory substance area 8, 18, 28. This sensory substance area 8, 18, 28 contains sensory substances as defined at the beginning. It can be applied by printing or impregnation to the outer side or to the inner side of the mouthpiece lining paper. However, it can also be applied as a coating or print to the outer side of the impervious layer 6, which is the side of the impervious layer 6 that faces the mouthpiece lining paper.

While cigarette paper 3, filter cover 4 and usually also mouthpiece lining paper 5 are porous as intended and are therefore air-permeable and open to diffusion, the material of the impervious layer 6 is, as intended, not or barely air-permeable and not or barely open to diffusion. Therefore, sensory substance is prevented from reaching the filter 2 from the sensory substance area 8, 18, 28 of the mouthpiece lining paper 5 and from getting from said filter into the lungs of the smoking individual with the smoke.

In order that, nevertheless, an air stream from the surroundings is added to the stream of smoke, the partial composite of the layer composite according to the invention, comprising impervious layer 6 and mouthpiece lining paper 5, is perforated by a grid of small apertures 7 approximately in the area of the longitudinal center of the filter part, in surface areas which are not provided with sensory substance. The perforating operation can be carried out directly on the cigarette machine by means of lasers, the laser already acting on the layer composite comprising mouthpiece lining paper and impervious layer. (The apertures 7 are normally so fine that they cannot be seen or can barely be seen with the naked eye on the finished cigarette.)

According to FIG. 1, the sensory substance area 8 is applied to the outer side of the mouthpiece lining paper 5. Preferably, a different composition and/or a different concentration of sensory substances is applied to the longitudinal half of the mouthpiece lining paper 5 on the tobacco rod side than to the longitudinal half facing away from the tobacco rod. The first longitudinal half primarily comes into contact with the fingers of the smoking individual and is therefore intended to have a different action than the second longitudinal half, which predominantly comes into contact with the lips of the smoking individual.

Figure 3:
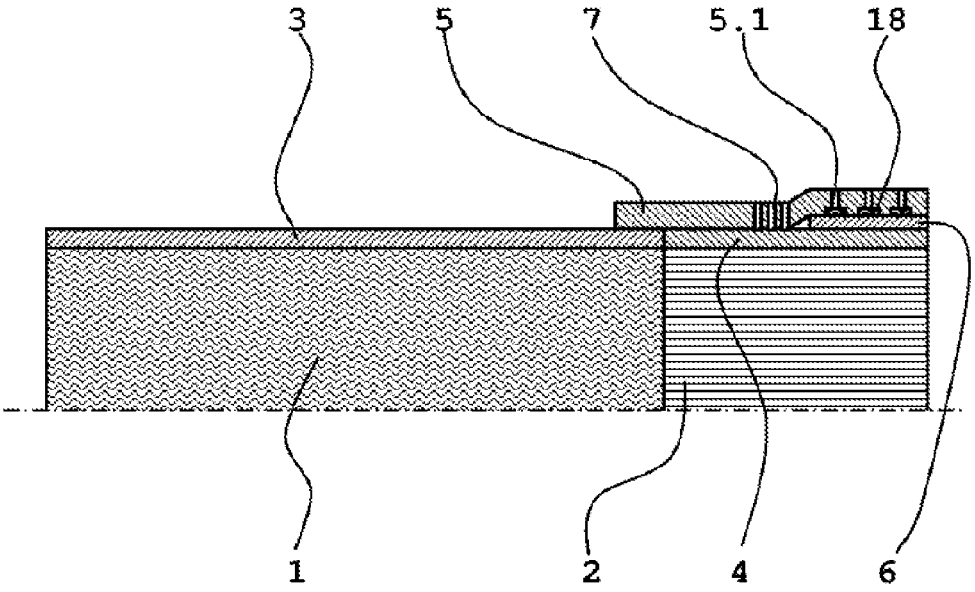
FIG. 3 shows a third filter cigarette equipped according to the invention by way of example in the same view as FIG. 1.
Figure 4:
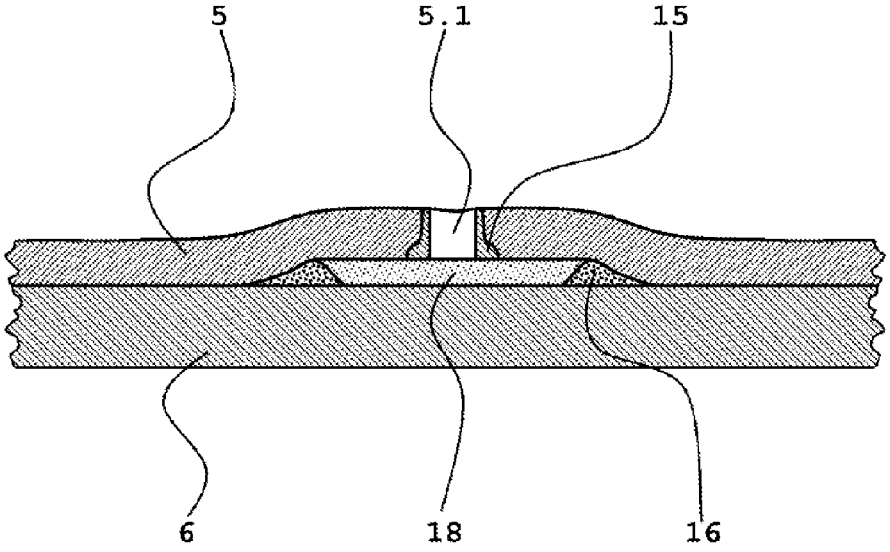
FIG. 4 shows a lateral sectional view of a detail of a fourth filter cigarette equipped according to the invention.

In the examples according to FIG. 2 and FIG. 3, the sensory substance area 18 is applied to the interface between impervious layer 6 and mouthpiece lining paper 5. In the course of production, it can have been applied either to the impervious layer 6 or to the mouthpiece lining paper 5. The arrangement of the sensory substance area 18 at the interface between impervious layer 6 and mouthpiece lining paper 5, as compared with the arrangement on the outer side of the mouthpiece lining paper, is primarily advantageous because the sensory substance area 18 can therefore be protected better against mechanical action. In this way, contact of the sensory substance area with parts of the cigarette machine and/or with the cigarette packing machine and/or with other cigarettes and/or with the cigarette pack can be avoided. Because of the nature of the sensory substances, the sensory substance area is often sensitive to abrasion or tends to stick.

If the mouthpiece lining paper 5 is not extremely thin and porous, it is advantageous to provide it, in the surface areas which are in contact with sensory substance area 18, with a perforation comprising a grid of fine apertures 5.1, in order that the sensory substances can easily reach the surface side touched by the smoking individual. As intended, these apertures 5.1 extend only through the mouthpiece lining paper 5 and in no case through the impervious layer 6, since otherwise the action according to the invention of the impervious layer 6 would be lost. As a result of these apertures 5.1, it is also possible to use as mouthpiece lining paper 5 an intrinsically diffusion-impervious film even when the sensory substance area 18 is arranged on the inner side of the mouthpiece lining paper. The apertures 5.1 can be formed so finely that they cannot be detected or can barely be detected by the naked eye.

The side of the mouthpiece lining paper 5 to which it is more advantageous to apply the sensory substance also depends on the type of sensory substance, in particular on the mobility thereof and on the sensitivity thereof to ambient conditions, such as light. On the inner side of the mouthpiece lining paper 5 and on the outer side of the impervious layer 6, the sensory substance is in particular better protected against light than if it is applied to the outer side of the mouthpiece lining paper 5; however, it cannot be touched and detected so quickly and directly by the lips of the smoking individual either.

Whether it is more advantageous to apply the sensory substance to the inner side of the mouthpiece lining paper 5, which then necessarily has to be designed to be porous, or to the outer side of the impervious layer 6, depends primarily on the adhesive properties of the sensory substance or of the accompanying substances containing the latter, and also on the production conditions for mouthpiece lining paper and impervious layer. If the consideration that the sensory substance can be applied not only to the mouthpiece lining paper 5 but (instead) also to the outer side of the impervious layer 6 is included, the range of sensory substances that can be used is expanded. If necessary, sensory substance can also be applied both to the impervious layer 6 and to the mouthpiece lining paper 5. Therefore, a larger quantity of sensory substance can be applied and sensory substances which are otherwise intrinsically difficult to mix can be combined.

In the embodiment according to FIG. 3 the length of the impervious layer 6 (in the axial direction of the filter cigarette) is shorter than the length of the mouthpiece lining paper 5, so that it extends substantially only in the sensory substance area 18 of the mouthpiece lining paper 5. The mouthpiece lining paper 5 is connected directly by its end region on the tobacco rod side to the cigarette paper 3.

In example 4, the manner in which a reservoir with sensory substance can be arranged between the impervious layer and the mouthpiece lining paper 5 is sketched by way of example.

On the outer side of the impervious layer 6, an annular elevation 16 is applied by means of a structured varnish, the enclosed volume of said elevation being filled with sensory substance and thus forming the sensory substance area 18. This structure, just like the whole of the impervious layer 6, is enclosed by mouthpiece lining paper. In over the center of the area of the sensory substance 18, the mouthpiece lining paper is provided with an opening 5.1, the diameter of which is considerably smaller than the diameter of the annular elevation 16. At the edge of the opening 5.1, the mouthpiece lining paper 5 is provided with an impregnation 15, the adhering and strengthening action of which protects the edge of the opening 5.1 against fraying. In addition, the impregnation 15 can of course also have the function of a further sensory substance and/or an optical function. Since a reservoir with a sensory substance is placed between the impervious layer 6 and the mouthpiece lining paper 5 and communicates with the outer side of the mouthpiece lining paper 5 only via a comparatively small opening 5.1, a comparatively very large quantity of sensory substance can be accommodated in a well protected manner and allowed to come into use slowly and in a well controlled manner.

Instead of delimiting the sensory substance area 18 by means of an annular elevation made of a separately applied structured varnish, the delimitation could also be formed by a local depression being produced on the impervious layer 6 or the mouthpiece lining paper 5, for example by means of embossing, laser treatment or grinding. Given a suitable, not excessively liquid, consistency of the sensory substance 18 and good adhesive bonding between mouthpiece lining paper 5 and impervious layer, no depression at all or no separately applied delimitation 16 is needed.

Figure 5:
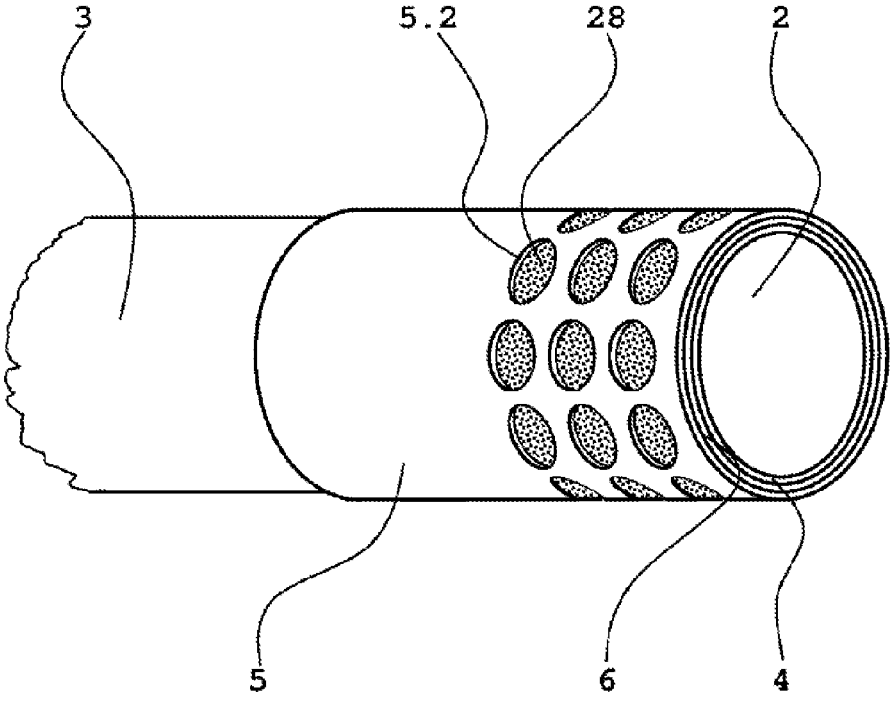
FIG. 5 shows a perspective view of a fifth filter cigarette equipped according to the invention by way of example.

In the embodiment according to FIG. 5, the mouthpiece lining paper 5 is provided with apertures 5.2, which are deliberately macroscopically large. Sensory substance is applied to the surface areas on the outer side of the impervious layer 6 that are exposed by the apertures and thus form the sensory substance areas 28. As intended, the apertures 5.2 are so large that, as the cigarette is smoked, the sensory substance areas 28 are touched directly by the lips or the fingers of the smoking individual. How large the cross-sectional area of the individual apertures 5.2 should at least be for this purpose depends on the shape and orientation of the cross-sectional area and on the thickness of the mouthpiece lining paper. In any case, the cross-sectional area should be at least 1 $mm^2$ for this purpose. By means of the shape and arrangement of the apertures 5.2 and also the color and type of application of the sensory substances, a contribution can be made to the visually attractive configuration of the cigarette. In this embodiment, crystals of sensory substances can be applied to the sensory substance area or sensory substances originally applied in liquid form there can be allowed to crystallize out. The fact that the sensory substance area 28 is arranged in a depression protected somewhat by the mouthpiece lining paper 5 means that sensory substances can also be applied thereto in the form of a sensitive layer, for example in the form of spots, relatively coarse particles or dusts.

It is also possible to provide the sensory substance area 28 with such a thick coating of sensory substance that this coating ends flush with the outer side of the mouthpiece lining paper 5 or projects slightly out of the latter. In these cases, the sensory substance layer must be at least so mechanically strong, at least on its outer surface, that it is not damaged during production and packing of the cigarette.

Figure 6:
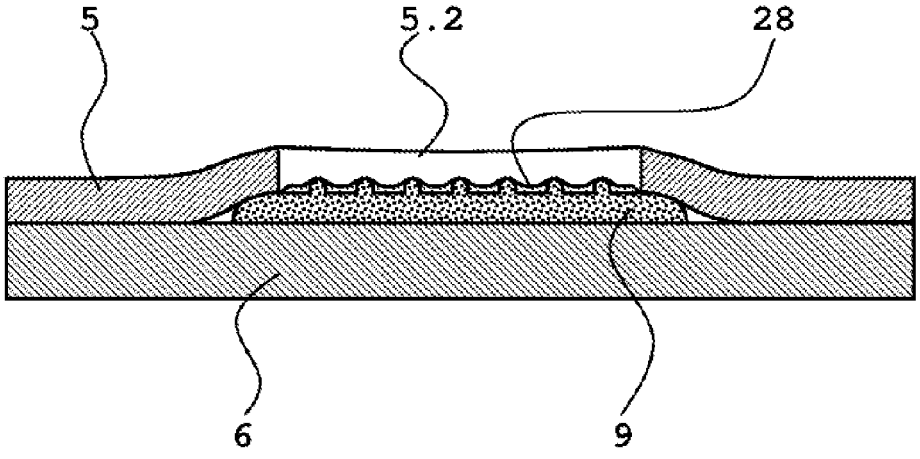
FIG. 6 shows a lateral sectional view of a detail of the filter cigarette from FIG. 5.

In the exemplary embodiment according to FIG. 6, the mouthpiece lining paper 5 has apertures 5.2 which are deliberately so large that they are visible to the naked eye, for example have diameters of several mm. At the points at which these apertures are located, the impervious layer 6 is provided with a local coating 9 that can be designated as a "sealing compound". This coating 9 can typically be a relatively hard wax, in on the outer surface of which a structure, for example in the form of a logo or a pattern, is embossed. It is primarily the more deeply located surface areas of this structure that form the sensory substance area 28.

In principle, materials which can be produced well as thin films are suitable as the material of the impervious layer 6.

It is particularly advantageous to form the impervious layer 6 from cellulose hydrate (also called "Zellglas" in German or "cellophane"), since, in addition to the ability to be produced well as a film, this can also be composted and, in the event of combustion, burns with approximately the same smell as dry wood or paper and in the process also forms approximately the same combustion products. A further considerable advantage of cellulose hydrate is that it is impermeable to liquids but allows water vapor to pass. This is advantageous for the microclimate in and on the filter. For example, even under extremely unfavorable ambient conditions, no formation of wetness as a result of water vapor condensation occurs on the impervious layer 6.

The impervious layer 6 can also be formed from polylactic acid or from starch. Thin films can also be produced very well from these materials, and the materials can be composted well.

Likewise, the impervious layer 6 can also be formed by a thin metal foil, preferably a thin aluminum foil. Of course, the impervious layer 6 can also be formed by a composite comprising a (thin) film and a (thin) paper layer, formed by adhesive bonding.

Cigarette paper 3, filter cover 4 and mouthpiece lining paper 5 consist of paper in the normal case, since the desired properties, above all with regard to combustibility, ability to be processed, porosity and environmental compatibility, can thereby be achieved easily. However, materials other than paper can also be used for these coverings within the idea of the invention.

In order not to have to make any large adaptations to cigarette machines for the production of filter cigarettes according to the invention, it is recommended to connect mouthpiece lining paper 5 and impervious layer 6 already during prior operations and also to apply the sensory substance previously to the mouthpiece lining paper 5 and/or to the outer side of the impervious layer 6.

In addition to the simple operating procedure in the cigarette machine, the additional advantage is therefore achieved that sensory substance does not come into contact with the moisture of that adhesive which is required for the connection operation to the filter cover paper. This avoids the annoying effect described at the beginning that sensory substance which has been applied to the mouthpiece lining paper is barely effective any more following the processing of the mouthpiece lining paper in the cigarette machine. This is because this loss of effectiveness appears to be caused by the moisture of the adhesive possibly having the effect that the sensory substance diffuses away from areas close to the surface into deeper areas and can therefore no longer be perceived.

In an advantageous embodiment, the mouthpiece lining paper 5 of a filter cigarette according to the invention is encased by an outer covering layer that can be removed by the user, typically can be pulled off by detaching a slight adhesive bond. This outer covering layer primarily has protective functions, similar to a "keep-fresh film". This protective function relates to protection of sensory substance areas against mechanical damage, protection of the sensory substance against premature escape into the surroundings, protection of the sensory substance against chemical change, for example as a result of oxidation with the atmospheric oxygen, protection against the take-up of substances such as typically water from the surroundings. Because the inner impervious layer 6 prevents diffusion of the sensory substance into the filter, more and different sensory substance can be applied than if this impervious layer were not present. By means of a removable outer covering layer, which also envelops the mouthpiece lining paper 5, further limitation to type and quantity of sensory substances are overcome.

Film materials and diffusion-impervious papers are primarily suitable for the material of the outer covering layer. Advantageous in particular are the materials comprising cellulose hydrate, polylactic acid and starch, since the films produced therewith are both sufficiently diffusion-impervious and easily biodegradable.

As a result of the embodiment according to the invention of a filter cigarette, in particular sensory substances which cause a "freshness effect" can for the first time be used easily to equip a mouthpiece lining paper.

The invention claimed is:

1. A layer composite used as covering for a filter of a smoking article, comprising:

a filter cover formed of a material open to diffusion;

a mouthpiece lining paper arranged outside said filter cover; and an impervious layer made of film material or diffusion-impervious paper being located between the mouthpiece lining paper and the filter cover;

wherein a sensory substance is applied to the impervious layer or to the mouthpiece lining paper as a sensory substance area, wherein the mouthpiece lining paper is in contact with the sensory area, and wherein the impervious layer is located between the sensory substance area and the filter cover that is open to diffusion, the impervious layer being impervious to the sensory substance present in the sensory substance area.

2. The layer composite as claimed in claim 1, wherein a partial composite comprising mouthpiece lining paper and impervious layer is perforated by a grid of apertures in a surface area which does not overlap a sensory substance area.

3. The layer composite as claimed in claim 1, wherein the sensory substance applied on a tobacco rod side of a longitudinal half of the mouthpiece lining paper has a different composition and/or a different concentration of sensory substances than the longitudinal half of the mouthpiece lining paper that faces away from the tobacco rod.

4. The layer composite as claimed in claim 1, wherein the sensory substance area and the impervious layer extend over only part of a longitudinal extent of the mouthpiece lining paper.

5. The layer composite as claimed in claim 1, wherein the sensory substance area is located on a side of the mouthpiece lining paper facing away from the impervious layer.

6. The layer composite as claimed in claim 1, wherein the sensory substance area is located at an interface between mouthpiece lining paper and impervious layer.

7. The layer composite as claimed in claim 6, wherein the mouthpiece lining paper is perforated by apertures in the area of the sensory substance area.

8. The layer composite as claimed in claim 1, wherein the sensory substance area is located on an outer side of the impervious layer and the mouthpiece lining paper is provided with apertures, wherein through these apertures, the sensory substance area can be touched by lips or fingers of an individual smoking the smoking article.

9. The layer composite as claimed in claim 8, wherein the apertures have a cross-sectional area that is at least 1 $mm^2$.

10. The layer composite as claimed in claim 8, wherein the impervious layer is provided locally at said apertures with a coating that consists of a compound that can be embossed.

11. The layer composite as claimed in claim 1, wherein different sensory substances are applied to mouthpiece lining paper and impervious layer.

12. The layer composite as claimed in claim 1, wherein the impervious layer comprises cellulose hydrate.

13. The layer composite as claimed in claim 1, wherein the impervious layer comprises polylactic acid.

14. The layer composite as claimed in claim 1, wherein the impervious layer comprises a metal foil.

* * * * *